United States Patent [19]

Sperry

[11] 4,111,613

[45] Sep. 5, 1978

[54] BLADDER ACTUATED PUMPING SYSTEM

[75] Inventor: Charles Richard Sperry, Wilton, Conn.

[73] Assignee: Sealed Air Corporation, Saddle Brook, N.J.

[21] Appl. No.: 770,527

[22] Filed: Feb. 22, 1977

[51] Int. Cl.[2] ..... F04B 43/10; F04B 45/06

[52] U.S. Cl. ..... 417/394; 92/93; 92/103 SD

[58] Field of Search ..... 417/394, 478; 92/90, 92/93, 103 SD

[56] References Cited

U.S. PATENT DOCUMENTS

| | | | |
|---|---|---|---|
| 2,196,993 | 4/1940 | Kidder | 417/394 |
| 2,948,223 | 8/1960 | Mashinter | 92/103 SD |
| 3,062,153 | 11/1962 | Losey | 417/478 |
| 3,132,808 | 5/1964 | Ott | 239/112 |
| 3,179,341 | 4/1965 | Plos et al. | 239/112 |
| 3,637,330 | 1/1972 | Goeldner | 417/394 |

FOREIGN PATENT DOCUMENTS

| | | | |
|---|---|---|---|
| 1,221,144 | 2/1971 | United Kingdom | 417/383 |

*Primary Examiner*—Carlton R. Croyle
*Assistant Examiner*—Thomas I. Ross
*Attorney, Agent, or Firm*—Lerner, David, Littenberg & Samuel

[57] ABSTRACT

A pumping system using an air actuated bladder type member to propel liquids out and to refill the pump. Invention covers such novel pumps and an overall dispensing system. Useful in pumping and dispensing liquids generally and is especially useful in dispensing polyurethane chemicals.

9 Claims, 6 Drawing Figures

BLADDER ACTUATED PUMPING SYSTEM

BACKGROUND OF THE INVENTION

This invention relates to a dispensing system for liquids, especially polyurethane foam precurser chemicals, and more particularly involves the use of an elastic membrane or bladder as one element of the propulsion means. I find that such construction provides a trouble-free long term pump which is useful over many pumping cycles.

The art of pumping liquids goes back a long way and literally thousands of different types of such devices undoubtedly exist. Classically, these have taken the form of mechanical devices of varying degrees of complexity and sophistication. In later historical times, some type of piston is usually found. And the materials of construction have often times varied as a function of the characteristics of the liquid, e.g., corrosive v. non-corrosive, that the pump is intended to be used with.

My principal aim in the present invention is to provide a rather simple pump with ease of operation, ready servicing when necessary, and which is so relatively inexpensive that its replacement imposes no substantial economic harm. Friction is hardly a factor and except for a pair of fluid in and fluid out ball valves and the bladder, there are no other moving mechanical parts in the pump. The pump operates merely by means of compressed gas, especially air, and no other energy sources are required. The air drives a tubular elastic member, the expansion of which propels the fluid out and the contraction of which serves to draw fluid into the pump body for the next pumping cycle. Such pump is, therefore, cyclical in operation.

The heart of the present pump and the present dispensing system is a tubular elastic member which is impervious to both the gas which causes it to expand and the liquid or fluid which it drives. The elastic member or bladder is fitted around a tubular support form and clamped at the ends thereof. Such assembly is positioned within a casing and when the bladder is expanded liquid is pumped out in a path that includes both the extra tubular and intratubular volumes. With the use of the tubular support liquid can always be expelled from my system regardless of the manner in which the expanded bladder fills the volume between casing and tube.

There are certain prior art patents which involve the use of elastic members to propel liquids from a container but none of such patents disclose the construction of the present pumping member.

U.S. Pat. No. 3,225,967 discloses a pumping system wherein the material to be propelled is contained within a bag-shaped diaphragm of rubber-elastic material and a surrounding gas within the container pressing against the bag provides the propulsion force. When the bag has beem emptied the unit is either thrown away or conceivably it can be refilled and reused but it nowhere has the continuous recycling utility of my invention. The system therein described is comparable to the common pressurized cans except that therein the inventor was addressing the problem of expelling contents which are somehow immiscible with the propelling gas. U.S. Pat. No. 3,240,399 is comparable in its mode of operation.

U.S. Pat. No. 3,361,303 discloses a liquid dispenser wherein the liquid is container within a stressed flexible bag and the propulsion force comes from the bag pressing upon the liquid. U.S. Pat. Nos. 3,672,543, 3,876,115 and 3,940,026 operate on substantially the same principles.

U.S. Pat. No. 2,109,549 discloses a means of evacuating a wedge shaped package by air pressure deforming an elastic member surrounding the package. The basic purpose appears to be the complete evacuation of containers of viscous liquids, e.g., grease.

U.S. Pat. No. 3,067,810 is directed to a fuel tank construction wherein air pressure is used to collapse a bladder unit which contains the fuel or other liquid.

None of the foregoing disclose the use of a tubular bladder member as described herein.

Accordingly a principal object of my invention is to provide a novel fluid pumping means employing a tubular, elastic bladder member.

Another object of my invention is to provide a novel liquid dispensing system utilizing said pumping means.

A more specific object of my invention is to provide a system for dispensing reactive liquids such as polyurethane chemicals and the like.

DESCRIPTION OF THE DRAWINGS

These and other objects, features and advantages of my invention will become apparent to those skilled in this art from the accompanying drawings in which.

DESCRIPTION OF THE INVENTION

Figure 1:
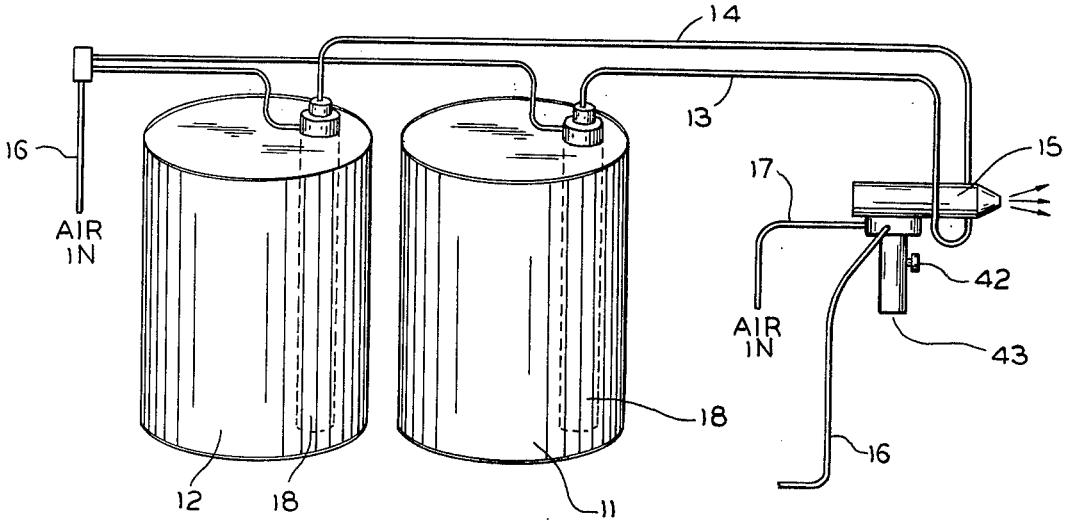
FIG. 1 schematically illustrates one overall embodiment of the present system.
Figure 2:
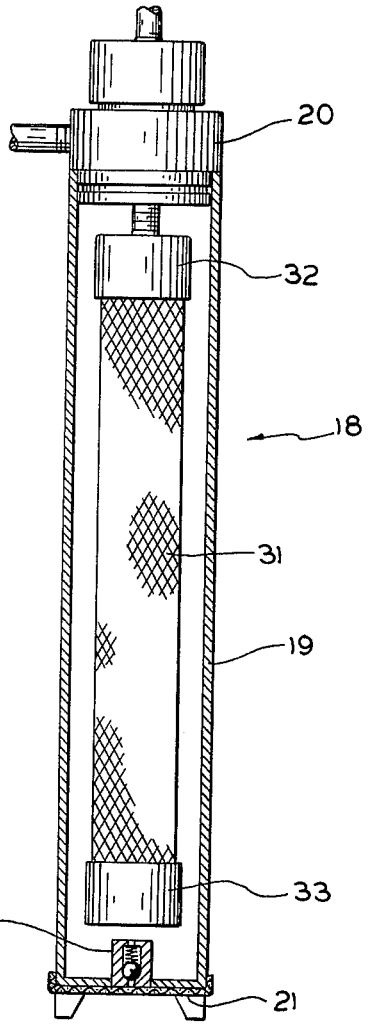
FIG. 2 is a partial sectional view of the bladder pumping assembly hereof.
Figure 3:
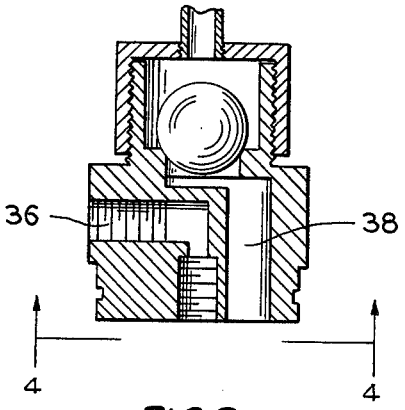
FIG. 3 is a sectional view of the top part of said pumping assembly.
Figure 4:
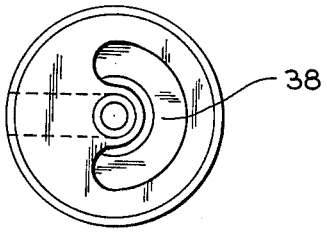
FIG. 4 is a cross-sectional view along lines 4—4 of FIG. 3.

FIG. 1 generally illustrates the present liquid dispensing system. While it is principally intended to be used for the dispensing of polyurethane foam precurser chemicals clearly it may be employed with other liquids or fluids generally. For purposes of illustration, however, I describe the system as used with polyurethane foam dispensing. There is illustrated a container 11 for polyol and a second container 12 for isocyanate (which are the principal polyurethane constituents). These feed respectively via hoses 13 and 14 to a mixing and dispensing gun 15 from whence the chemicals are poured or sprayed for use. Also included in the system are lines for a pressurizing gas, especially air, 16 and 17, the purpose of which will be set forth as this description proceeds.

Within the containers 11 and 12 are pump assemblies 18. In structure, these are precisely the same and it is such assembly or assemblies which form the heart of the present dispensing system. Reference should next be had to FIGS. 2 through 5 for an understanding of the construction of such assemblies:

There is a cylindrical metal casing 19 closed by an upper cap member 20 and a foot plate 21. Centrally located in such foot plate is a ball valve assembly generally noted by the numeral 22. This consists of a ball 23, ducts 25 and 26 and a valve seat 27. A screen 24 covers the bottom.

Axially positioned in the casing is a bladder pump unit generally noted by numeral 28. This consists of a cylindrical metallic tube 29 open at both of its ends. Concentrically surrounding such tube is a tubular bladder member 30 and concentric to it is a tubular mesh retaining means 31. Top and bottom caps 32 and 33 lock, by means of crimped fit, the bladder and mesh around the ends of tube 29. Both such caps are ring-shaped with central holes. The pump unit 28 is supported within casing 19 by a pipe 34 the upper end of which is threadedly engaged with the underside of a cap 20. The lower portion 34*a* of such pipe is formed into a right angled bend and ends at a hole through tube 29.

The cap assembly 20 will next be described. There is a cap head 35 which may be threaded or press-fitted as shown at the top of casing 19. An air inlet fitting 36 in the cap head communicates with the bore of pipe 34 via an angled chamber 37. There is a liquid exit port 38 stopped by upper ball valve 39 and a threaded cap 40 which connects into a liquid line, e.g., 13 or 14 as the case may be.

The description continues in conjunction with the operation of the apparatus. The pump assemblies 18 are positioned in containers 11 and 12 as shown in FIG. 1. Such containers are preferably 55 gallon metal drums and it is preferred that the assembly be of such length to extend from the top of the drum to the bottom thereof. The assembly 18 cannot sit on the bottom for this could or would block the introduction of liquid via ball valve 22. Accordingly a footed bottom is provided. The pump assembly is normally made to fit through the usual tap hole of 55 gallon drums, although certainly other sizes may be used. To support the pump a retaining collar (not shown) may be used.

The system includes a mixer-dispenser 15. While a variety of such units may be employed, I prefer the dispensing gun described and claimed in my U.S. Pat. No. 3,687,370, the disclosure of which is incorporated by reference herein. Such dispensing gun has a valving rod which preferably is movable by air pressure to open and close the gun. In the present system, I include a source of compressed air (not illustrated), or other inert gas, which both operates the gun via line 17 and pressurizes the pumping assemblies 18 via line 16. When the gun trigger 42 is pressed inwardly, the gun is placed in the dispense mode and concurrently air is fed into the pumping assembly via hose 16. When the trigger 42 is released the pressure is released and the system is vented through vent port 43 in the gun handle. With such venting the dispenser closes and the pump assemblies 18 refill.

Figure 5:
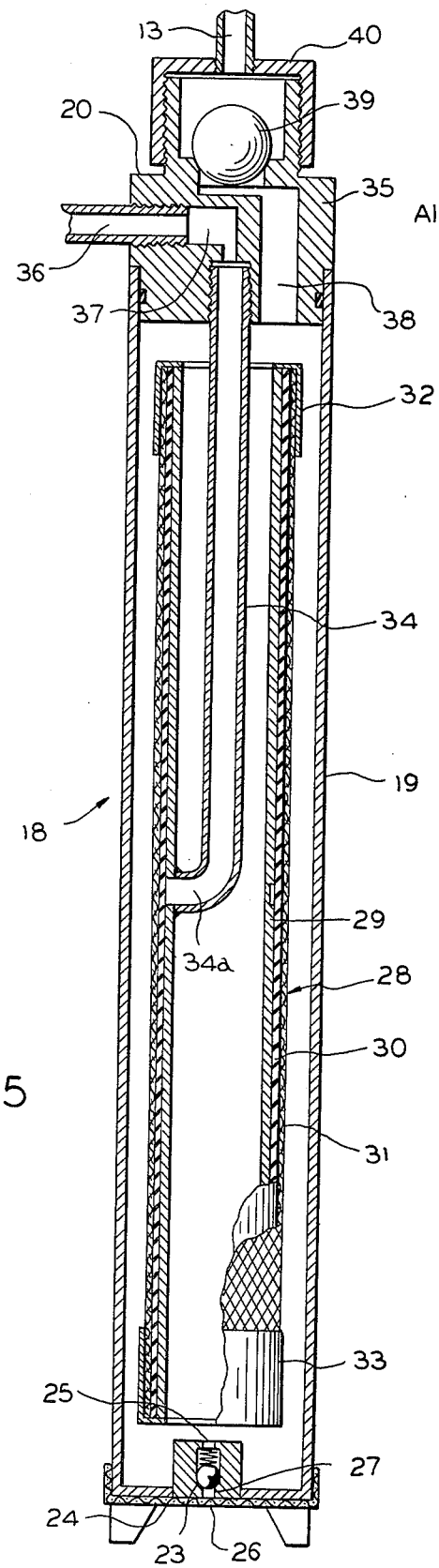
FIGS. 5 and 6 are longitudinal sectional views of the bladder pump assembly respectively in the filling or quiescent and pumping states.
Figure 6:
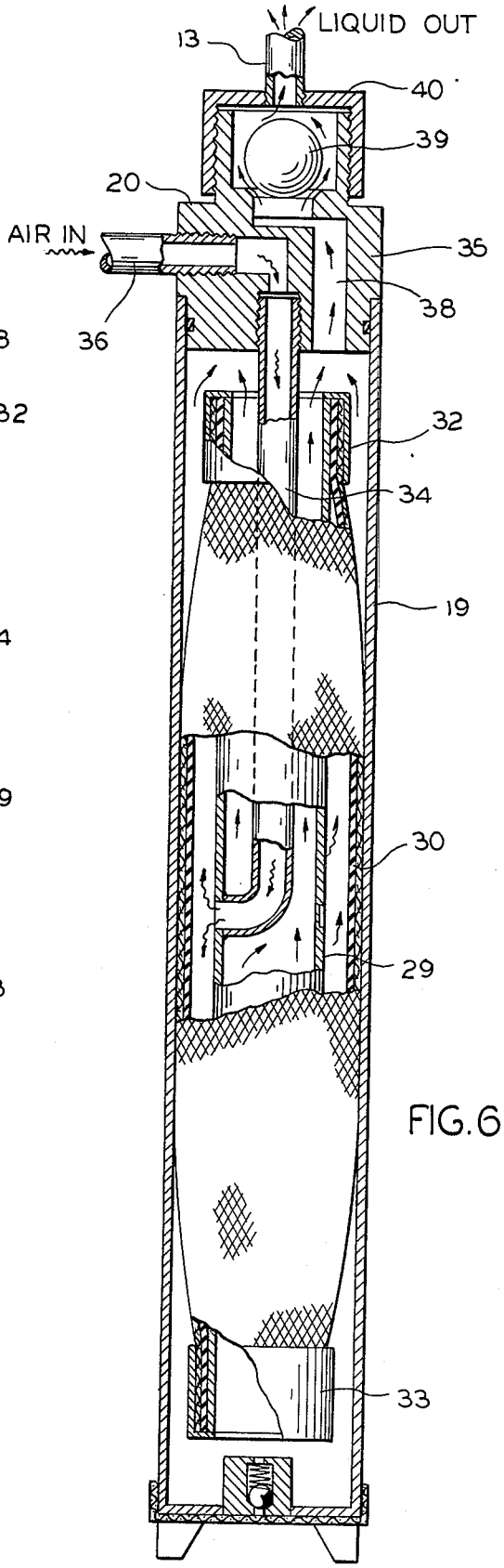

Reference should next be had to FIGS. 5 and 6:

In FIG. 5 the pumping assembly 18 is full of the liquid to be dispensed. Such liquid occupies all of the volume both around the bladder assembly and in the bore of the tube 29. When trigger 42 is actuated air flows through line 16, through members 36, 37, 34 and out of the hole at the end of pipe segment 34*a*. Such outrushing air moves the bladder 30 and its associated mesh support 31 outwardly from the position shown in FIG. 5 to that shown in FIG. 6. Concurrently, the lower ball valve 22 is tightly closed as a result of the pressure established within casing 19. As the pressure builds and the bladder expands liquid flows out of the chamber via conduit 38, ball valve 39 opens and the liquid flows into lines 13 or 14, as the case may be. The liquid streams then enter the mixing gun 15 and are emitted therefrom.

Pumping action may continue until the displaced volume of the assembly 18 has been evacuated, i.e., the volume of liquid displaced by the volume of expanded bladder. Since the bladder 30 is air impervious at this point, even though the bladder is maintained in the expanded, stressed position, there is no further flow of liquid.

When the trigger 42 is released the gun closes and liquid flow ceases. Simultaneously air flow through line 16 stops. I provide a venting means noted above whereby bladder pressure is released and the bladder returns from the position shown in FIG. 6 to that of FIG. 5. There then results a negative pressure within container 18. Ball valve 39 closes and ball valve 22 opens. As a result liquid in container 11 is drawn into assembly 18, thus refilling it preparatory to the next dispense cycle.

While the tubular bladder 30 may be formed of a variety of plastic materials, I find that butyl rubber is excellently suited for this purpose. It is impermeable, at least for purposes of this invention, to both compressed air and the polyurethane chemicals noted above. It should be of such reasonable thickness and elastic strength to last for thousands of pumping cycles. In the relaxed position (FIG. 5) such bladder should tightly fit around the support 29 and accordingly it should have a slightly smaller internal diameter than the O.D. of such support tube. A further requirement of the bladder is that it have good elastic memory; when the actuating air pressure is vented off it should tightly collapse around tube 29.

The support mesh 31 is readily formed of plastic such as braided nylon or the like. Its basic function is to protect the bladder at the bladder-cap junction and to help restrain the bladder from forming into angular protrusions which could reduce bladder life. While the use of such mesh is not absolutely necessary in an operable pump, I find that this is preferred.

In the preferred embodiment hereof, the outlet at tube segment 34*a* is generally midway along the length of tube 29. I do this to best assure that the bladder becomes regularly extended as illustrated in FIG. 6.

It will be understood that modifications and variations may be effected without departing from the spirit or scope of the novel concepts of this invention.

I claim as my invention:

1. A pump comprising a tubular casing, fluid inlet means at one end of said casing, fluid outlet means at the other end of said casing, a tubular support member positioned in said casing in substantial axial alignment therewith, an elastic pumping member disposed about the outer surface of said tubular support member, pump means for expanding and contracting said elastic pumping member so that it alternately expands and seals against the inner surface of said tubular casing and contracts back to said tubular support member, and a fluid flow path through said tubular support member which connects said inlet means to said outlet means, said fluid flow path being fluidly connected to a volumetric area which is partially defined by at least a portion of the exterior of said elastic pumping member disposed closest to said one end of said casing and which volumetric area fluidly communicates with said fluid inlet means.

2. A pump according to claim 1, further comprising a further flow path which fluidly connects a second volumetric area which is partially defined by at least a portion of the exterior of said elastic pumping member disposed closest to said other end of said casing and which second volumetric area fluidly communicates with said fluid outlet means.

3. A pump according to claim 1, wherein said elastic pumping member is connected to said tubular support member at each end thereof by end caps, and said fluid flow path includes holes through said end caps.

4. A pump according to claim 1, further comprising a flexible retaining member disposed about said elastic pumping member and adapted to protect it and restrain it from inflating into angular protrusions which would otherwise tend to cause it to wear at an increased rate.

5. A pump according to claim 4, wherein said flexible retaining member is made of a plastic mesh and is held in position about said elastic pumping member by said end caps.

6. A pump according to claim 1, wherein said pump means includes a fluid tight chamber defined by the outer surface of said tubular support member and the inner surface of said elastic pumping member.

7. A pump according to claim 6, wherein said tubular support member includes end caps which seal the ends of said elastic pumping member to said tubular support member to form said fluid tight chamber.

8. A pump according to claim 7, wherein said pump means comprises a fluid conduit disposed in said tubular support member, said fluid conduit terminating in an opening formed in said tubular support member and disposed substantially centrally along the length thereof, said opening communicating with said fluid tight chamber.

9. A pump according to claim 6, wherein said pump means comprises a fluid conduit disposed in said tubular support member, said fluid conduit terminating in an opening formed in said tubular support member and disposed substantially centrally along the length thereof, said opening communicating with said fluid tight chamber.

* * * * *